US009848671B2

(12) United States Patent
Mueller

(10) Patent No.: US 9,848,671 B2
(45) Date of Patent: Dec. 26, 2017

(54) ITEM OF FOOTWEAR

(75) Inventor: Karl Mueller, Roggwil (CH)

(73) Assignee: Joya Schuhe AG, Roggwil (CH)

( * ) Notice: Subject to any disclaimer, the term of this patent is extended or adjusted under 35 U.S.C. 154(b) by 0 days.

(21) Appl. No.: 13/985,625

(22) PCT Filed: Oct. 21, 2011

(86) PCT No.: PCT/EP2011/068392

§ 371 (c)(1),
(2), (4) Date: Aug. 15, 2013

(87) PCT Pub. No.: WO2012/110113

PCT Pub. Date: Aug. 23, 2012

(65) Prior Publication Data

US 2013/0318834 A1 Dec. 5, 2013

(30) Foreign Application Priority Data

Feb. 18, 2011 (CH) ..... 287/11

(51) Int. Cl.
*A43B 13/12* (2006.01)
*A43B 13/18* (2006.01)

(52) U.S. Cl.
CPC ..... *A43B 13/12* (2013.01); *A43B 13/127* (2013.01); *A43B 13/186* (2013.01); *A43B 13/188* (2013.01)

(58) Field of Classification Search
CPC ..... A43B 13/12; A43B 7/144; A43B 13/186; A43B 5/00; A43B 13/125; A43B 13/143;
(Continued)

(56) References Cited

U.S. PATENT DOCUMENTS 4,348,821 A * 9/1982 Daswick ..... 36/103
4,364,189 A * 12/1982 Bates ..... 36/31
(Continued)

FOREIGN PATENT DOCUMENTS

CN 2935893 Y 8/2007
DE 3306425 8/1984
(Continued)

OTHER PUBLICATIONS

Chinese Office Action issued in corresponding Chinese Patent Application dated Feb. 3, 2016.

*Primary Examiner* — Alissa L Hoey
*Assistant Examiner* — Catherine M Ferreira
(74) *Attorney, Agent, or Firm* — Davis & Bujold PLLC; Michael J. Bujold

(57) ABSTRACT

In an item of footwear having a sole and an upper, the sole includes at least one upper layer, which is directed towards the upper, and at least one lower layer, which is directed away from the upper. The upper layer and the lower layer are made of materials having different levels of elasticity, density or hardness. The side of the sole which is directed towards the upper forms a bearing surface for the foot, with a heel zone and a ball-of-the-foot zone. The lower layer passes through the upper layer at least in part such that a bearing surface is formed by regions of the lower layer and of the upper layer. This construction makes it possible to combine the different materials' properties in the region of the bearing surface.

10 Claims, 6 Drawing Sheets

Figure 1:
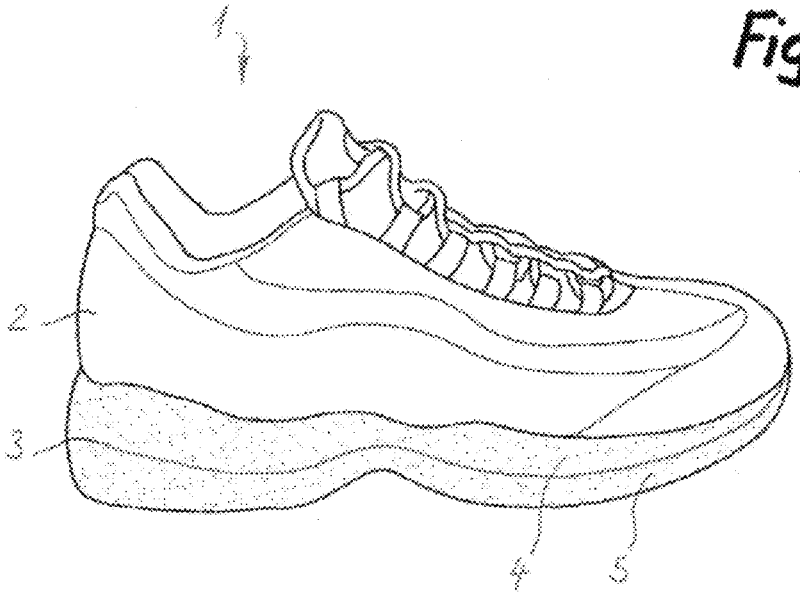

(58) Field of Classification Search
CPC ..... A43B 13/146; A43B 13/18; A43B 13/181; A43B 13/188; A43B 7/142; A43B 13/10; A43B 13/14; A43B 13/141; A43B 13/185; A43B 7/1425; A43B 7/1445; A43B 13/223; A43B 7/148; A43B 13/26; A43B 5/02; A43B 13/026; A43B 13/187; A43B 7/32; A43B 13/122; A43B 13/127; A43B 5/06
USPC ..... 36/30 R, 28, 44, 103, 114
See application file for complete search history.

(56) References Cited

U.S. PATENT DOCUMENTS

| | | | | |
|---|---|---|---|---|
| 4,439,937 | A * | 4/1984 | Daswick | 36/107 |
| 4,674,205 | A * | 6/1987 | Anger | 36/44 |
| 6,329,441 | B1 * | 12/2001 | Okubo et al. | 521/137 |
| 7,700,021 | B2 * | 4/2010 | Cox et al. | 264/132 |
| 8,117,769 | B2 * | 2/2012 | Steele | 36/102 |
| 8,202,600 | B2 * | 6/2012 | Okada et al. | 428/91 |
| 8,615,835 | B2 * | 12/2013 | Hoffer et al. | 12/142 R |
| 8,756,831 | B2 * | 6/2014 | Spanks et al. | 36/19.5 |
| 8,776,399 | B2 * | 7/2014 | Tsai | 36/44 |
| 2002/0092202 | A1 * | 7/2002 | Masseron | 36/28 |
| 2007/0283599 | A1 * | 12/2007 | Talbott | 36/129 |
| 2008/0313924 | A1 * | 12/2008 | Righetto | 36/28 |
| 2010/0126043 | A1 * | 5/2010 | Loverin et al. | 36/103 |
| 2011/0030245 | A1 * | 2/2011 | Truelsen | 36/30 R |

FOREIGN PATENT DOCUMENTS

| | | |
|---|---|---|
| DE | 69908532 | 4/2000 |
| EP | 0041201 | 12/1981 |
| EP | 0995364 | 4/2000 |
| EP | 2111771 | 10/2009 |
| FR | 2297580 | 8/1976 |
| GB | 1152212 | 5/1969 |
| WO | 2009/010933 | 1/2009 |

* cited by examiner

ITEM OF FOOTWEAR

The invention relates to an item of footwear according to the preamble of claim 1. Such items of footwear with a multilayered sole construction of different materials have been known and customary for some time. They are generally intended to achieve certain walking properties, to make it easier for the user to walk.

An item of footwear with a sprung sole and with a multilayered sole construction is disclosed for example by WO 2009/010933. The sole construction consists of a midsole, a buffer sole and an abrasion-resistant outsole.

One disadvantage of the known designs is that the material properties of the various bearing zones for the foot are given too little consideration. The starting point for the invention is therefore the recognition that, depending on the properties desired, the bearing surface for the sole of the foot requires different material properties for support. For example, the main proportion of the bodyweight is borne by the heel and by the ball of the foot, but even here different material properties for the load-bearing sole are possibly desired.

It is therefore an object of the invention to provide an item of footwear of the type mentioned at the beginning that ensures optimum support of the foot. In this case, different regions of the bearing surface for the foot are intended to have different material properties, in order to improve the wearing comfort and the supporting effect. This object is achieved by an item of footwear that has the features in claim 1.

In this case, the lower layer passes at least partially through the upper layer in such a way that the bearing surface is formed by regions of the lower layer and of the upper layer, it being possible as a result of the different material properties, in particular the elasticity, density or hardness, of these layers to achieve a specific sprung effect.

In this case, at least the ball-of-the-foot zone lies in a region of the lower layer and at least the heel zone lies in a region of the upper layer. Because the upper layer is formed to be harder than the lower layer, this obviously has the effect that the entire region of the ball of the foot can roll on soft material and that the heel is supported by the less elastic upper layer.

The upper layer and the lower layer advantageously consist of a polymer material, such as for example polyurethane. However, other materials are also conceivable, individually or in combination, such as for example ethylene vinyl acetate (EVA), rubber or composite materials.

Particularly good results can be achieved if the upper layer has a Shore C hardness in the range from 38 to 42 and the lower layer has a Shore C hardness in the range from 28 to 34. Preferred values are a Shore C of 40 for the upper layer and a Shore C of 30 for the lower layer, with a tolerance range of +/−1.

The material density also plays a particular part in determining the wearing comfort and in maintaining the walking properties. The upper layer in this case advantageously has a density in the range from 0.34 to 0.37 g/cm$^3$ and the lower layer advantageously has a density in the range from 0.28 to 0.31 g/cm$^3$.

The upper layer and the lower layer may be firmly adhesively bonded to one another, so that a compact sole construction is achieved. However, material-bonded welding or else just releasable snapping-together, with corresponding snap connections, would also be conceivable.

Preferably, on the bearing surface the region of the upper layer surrounds the region of the lower layer completely.

Consequently, the surrounding outer edge of the bearing surface is obviously formed completely by the harder upper layer.

The area of coverage of the lower layer on the bearing surface may vary according to what form the walking properties take. However, it advantageously lies approximately between 25% and 45% of the overall bearing surface. In this way, the foot is supported for the greater part, and in particular over the greater part of its longitudinal arch, by the harder upper layer.

The sole has in the longitudinal direction of the footwear a longitudinal inner side and a longitudinal outer side. It is obvious that, in the case of a pair of shoes, the longitudinal inner sides of the soles are directed toward one another and the longitudinal outer sides are directed away from one another. Particularly advantageous rolling characteristics can be achieved if the upper layer bulges convexly into the lower layer between the ball-of-the-foot zone and the heel zone on the longitudinal inner side. The upper layer is in this case formed in the manner of a dome, so that the convex form obviously also extends transversely in relation to the longitudinal inner side.

The upper layer may have on the longitudinal outer side an approximately constant vertical height, the vertical height of the lower layer being able to increase continuously from the ball-of-the-foot zone to the heel zone.

The upper layer may be firmly connected at its outer periphery to the associated upper of the item of footwear. Depending on the form of the bearing surface, an additional insole is not required. Furthermore, the lower layer may directly form the visible outsole of the item of footwear. Since the lower layer consists of softer material, it may however also be expedient if it rests on a separate outsole of harder material. This prevents abrasion from occurring too quickly. The outsole may also completely envelop the upper layer and the lower layer and, for example, likewise be connected to the upper of the item of footwear. Furthermore, instead of an insole, the bearing surface of the sole may only be covered by a flexible textile sheet-like formation, which for example goes over directly into the inner lining of the upper of the item of footwear.

At least in the region between the heel zone and the ball-of-the-foot zone, the upper layer may be provided with openings, which pass completely or partially through the upper layer. These openings improve the ventilation in the region of the bearing surface, and with each compression and compression relief they bring about a certain pumping effect.

Finally, it is also advantageous if the upper layer is provided over the greater part of its outer periphery or over its entire outer periphery with a drawn-up supporting border. This forms a footbed, in which the foot rests as far as possible with a form fit. Furthermore, this border facilitates the fastening of the outsole. The upper of the item of footwear could consequently also consist of a very flexible material, such as for example of a textile material, or the upper of the item of footwear could be formed just as a half slip-on shoe.

Figure 2:
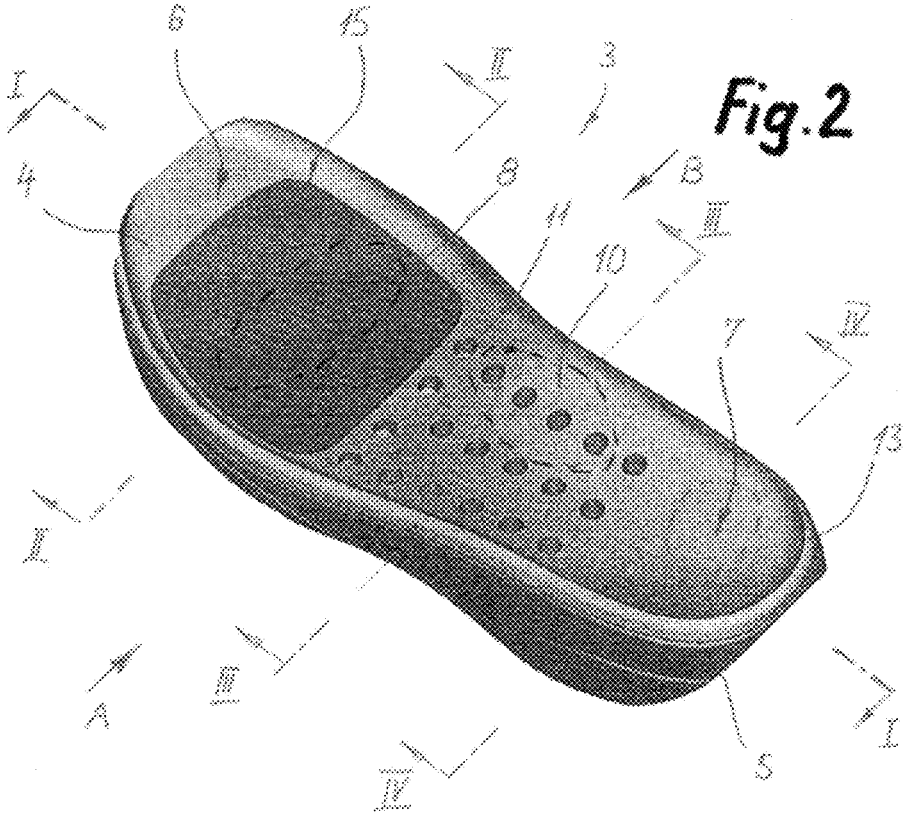
Figure 3:
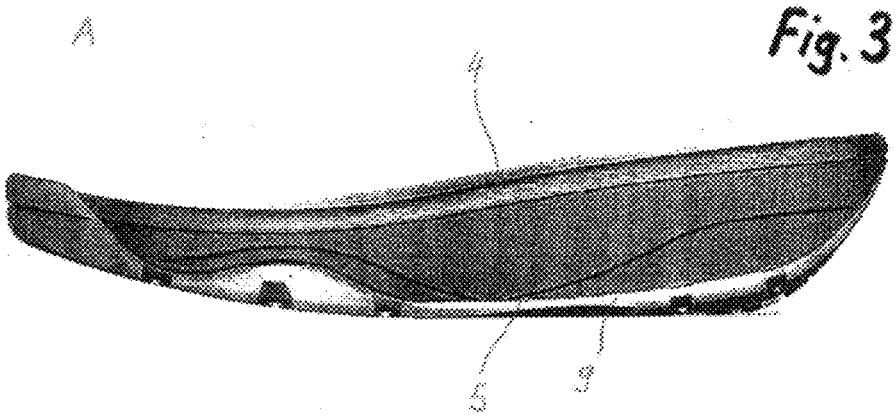
Figure 4:
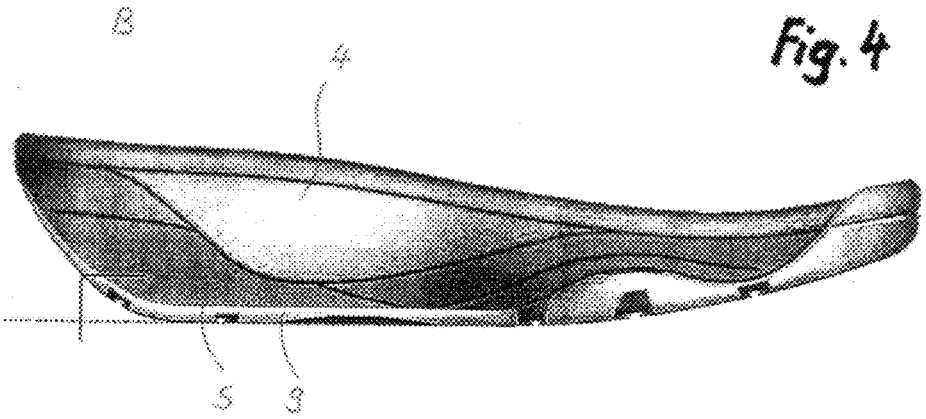
Figure 5:
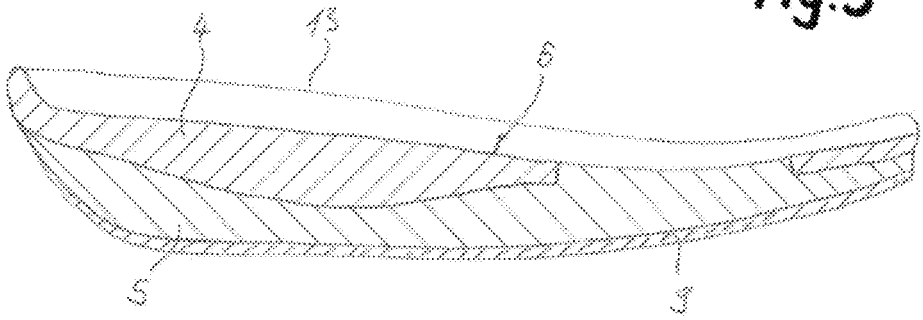
Figure 6:
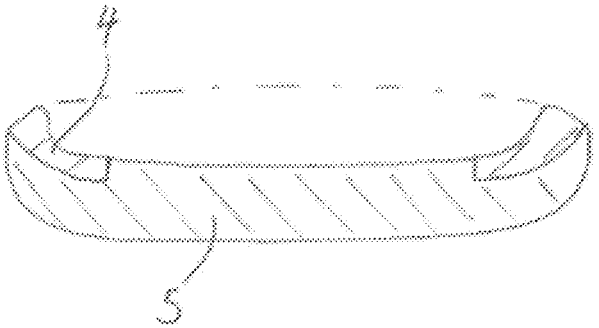
Figure 7:
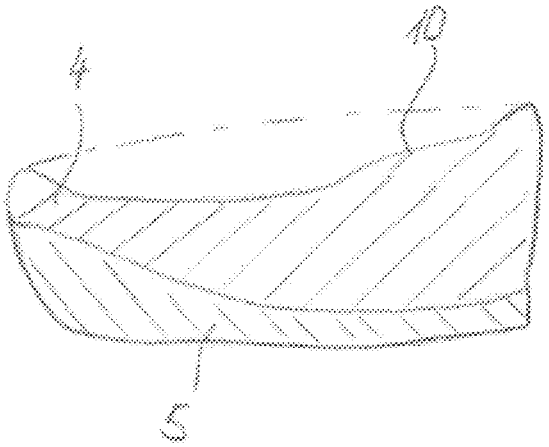
Figure 8:
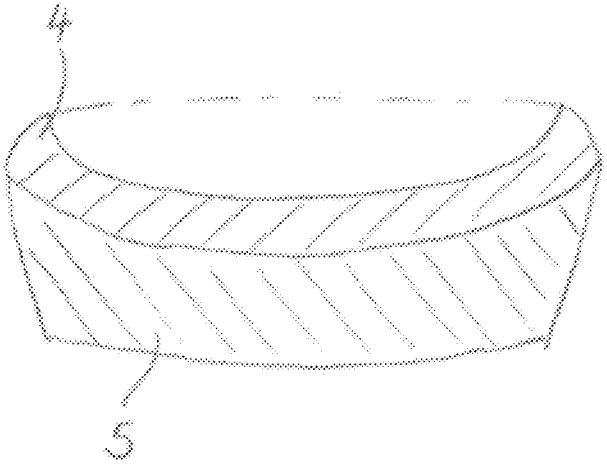
Figure 9:
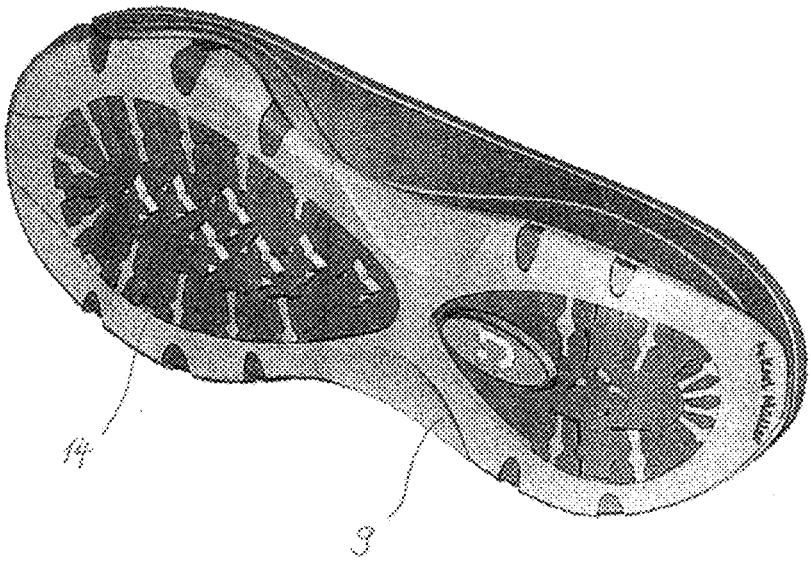
Figure 10:
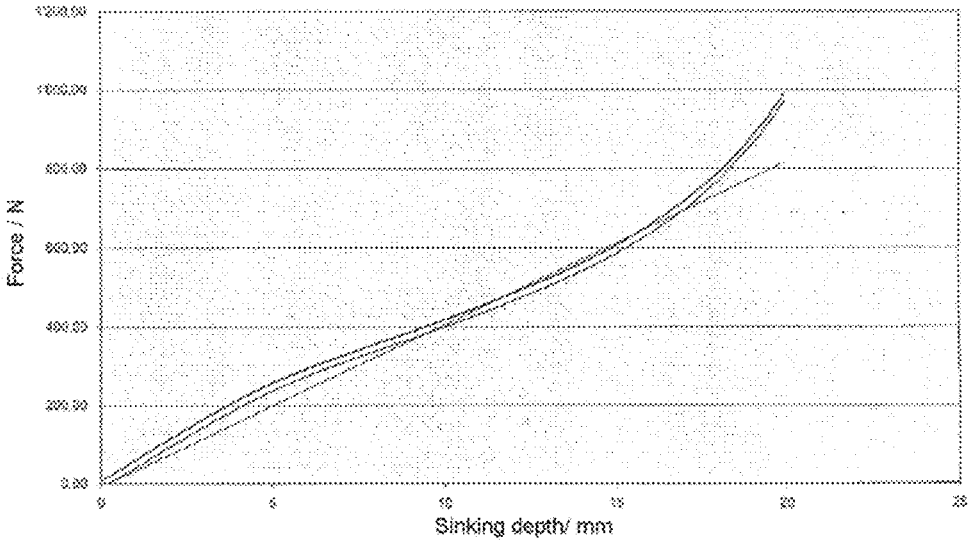
Figure 11:
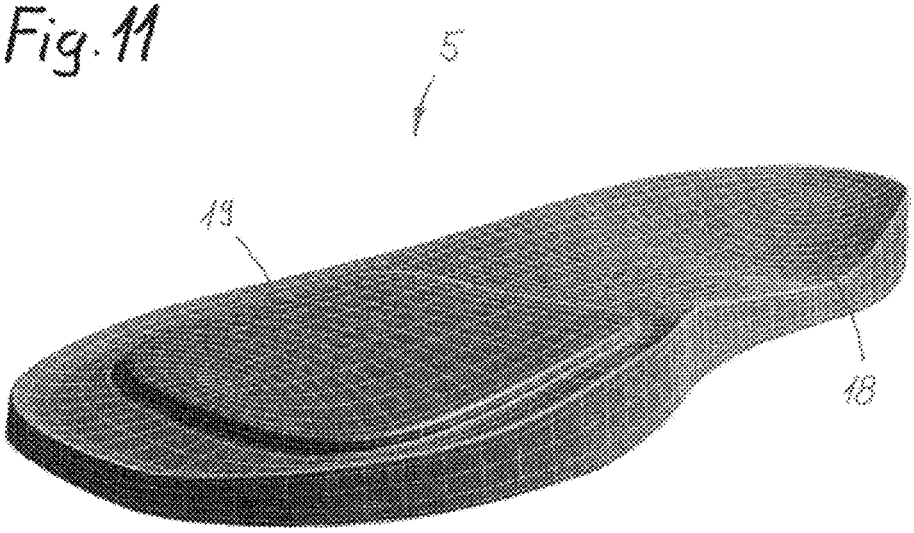
Figure 12:
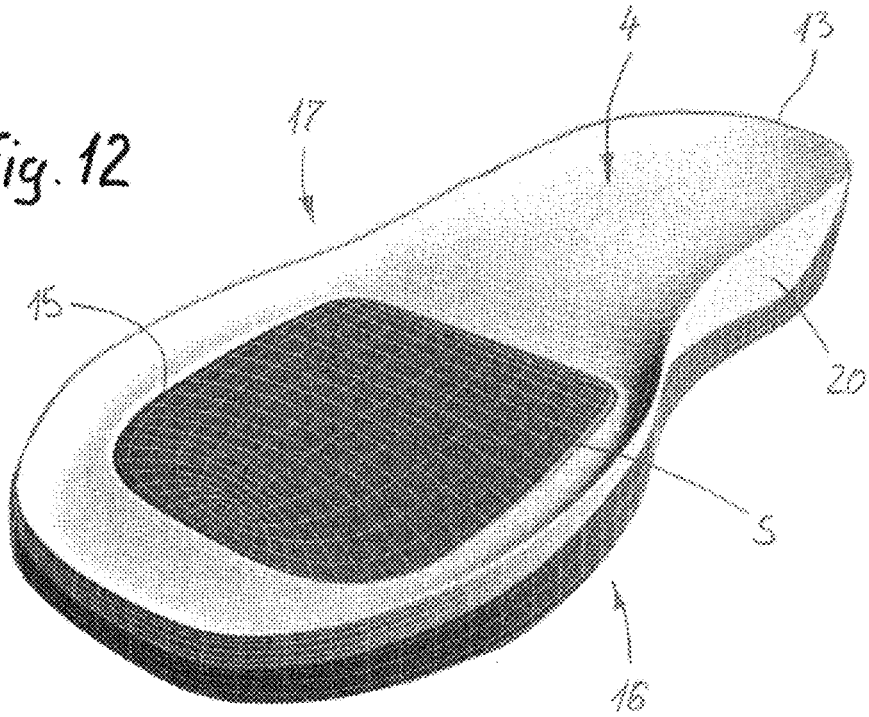
Figure 13:
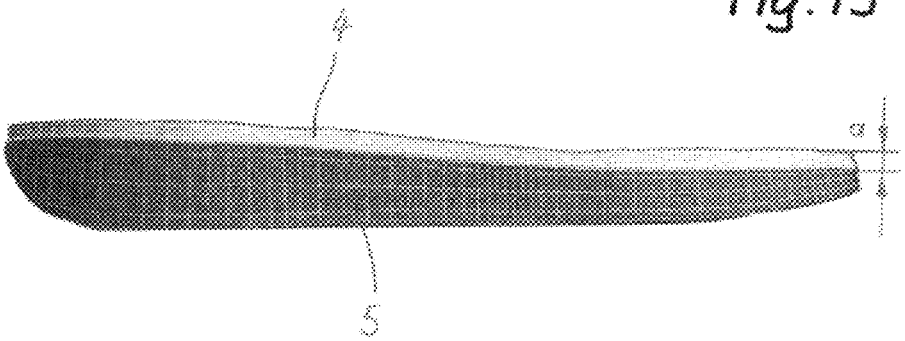
Figure 14:
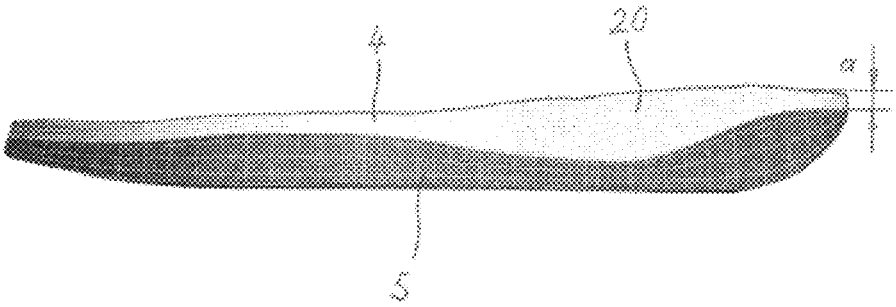

Further individual features and advantages of the invention emerge from the following description of exemplary embodiments and from the drawings, in which:

FIG. 1 shows an outer view of an item of footwear with a two-part sole construction, FIG. 2 shows a perspective view of a sole construction according to the invention without an upper, FIG. 3 shows a side view of the sole construction according to FIG. 2 from the direction of the arrow A, FIG. 4 shows a side view of the sole construction according to FIG. 2 from the direction of the arrow B, FIG. 5 shows a longitudinal section through the sole construction according to FIG. 2 in the plane I-I, FIG. 6 shows a cross section through the sole construction according to FIG. 2 in the plane II-II, FIG. 7 shows a cross section through the sole construction according to FIG. 2 in the plane III-III, FIG. 8 shows a cross section through the sole construction according to FIG. 2 in the plane IV-IV, FIG. 9 shows the sole according to FIG. 2 in a perspective view from below, FIG. 10 shows a force-displacement diagram on the basis of a sole according to the invention, FIG. 11 shows a perspective representation of the lower layer of a further exemplary embodiment, FIG. 12 shows a perspective representation of a sole with the lower layer according to FIG. 11, FIG. 13 shows a view of the longitudinal outer side of the sole according to FIG. 12, and FIG. 14 shows a view of the longitudinal inner side of the sole according to FIG. 12.

The item of footwear 1 according to FIG. 1 consists of an upper 2 and a sole 3. The upper of the item of footwear may in principle be formed in any way desired, and it may be both a lace-up shoe and a slip-on shoe. The sole 3 has an upper layer 4 and a lower layer 5, these layers not necessarily having to be visible from the outside.

The sole 3 represented in FIG. 2 consists in turn of an upper layer 4 and a lower layer 5. The foot lies on a bearing surface, designated as a whole by 6, and the upper layer 4 may have a supporting border 13 in the region of the two longitudinal sides and in the region of the heel. The upper layer 4 has in the region of a ball-of-the-foot zone 8 a cutout 15, in which the lower layer 5 passes through the upper layer 4 to the plane of the bearing surface 6. A heel zone 7 is completely formed by the harder upper layer 4. The region of the bearing surface 6 that is formed by the softer lower layer has an approximately rectangular configuration with rounded corners. Other configurations would of course be conceivable. Arranged between the heel zone 7 and the ball-of-the-foot zone 8 is a supporting bulge 10, which lies asymmetrically, nearer to the inner side of the foot. In the midfoot region, a number of openings 11, which pass through the entire upper layer 4, are arranged at specific intervals. These openings are not present in the heel region. The supporting bulge 10 is obviously integrated directly in the upper layer 4, the upper layer consisting here of a harder material than the lower layer 5. In FIG. 2, a sole for a left item of footwear is represented. The sole construction for the corresponding right item of footwear would of course be mirror-symmetrical. However, it would also be conceivable that, for orthopedic reasons, the sole construction is formed differently for the left item of footwear and the right item of footwear.

As is obvious from FIGS. 3 and 4, an outsole 9, which has a relatively small wall thickness and is drawn up at the sides, may also be arranged in addition to the upper layer and the lower layer. As shown, the interengagement of the upper layer 4 and the lower layer 5 may also be used for design purposes, for example by means of different coloration.

It can be clearly seen in the longitudinal section according to FIG. 5 how the lower layer 5 passes through the upper layer 4, so that it forms a specific region of the bearing surface 6. In this region, the material properties of the lower layer 5 exclusively come into effect under loading, while the material properties of both layers respectively have a cumulative effect in all of the other regions.

It is obvious in particular from FIGS. 6 to 8 how the composition of the two layers 4 and 5 changes almost in every sectional plane. In the region of the ball-of-the-foot zone 8, the upper layer 4 is present virtually only at the left and right borders. By contrast, the upper layer 4 is massively formed in the region of the midfoot and in the region of the supporting bulge 10, and diminishes towards the outer side of the foot. In the heel region, the upper layer 4 and the lower layer 5 are formed with approximately the same thickness over the entire cross section, as is obvious from FIG. 8, the proportion of material of the lower layer being greater than that of the upper layer. FIG. 7 is a cross section through the sole construction according to FIG. 2 along section line III-III. As shown, the thicknesses of the upper and the lower layers 4, 5 of the sole vary along the cross section of the sole 3. As generally, the cross section extends normal to both the upper and the lower layers 4, 5 and through the bulge 10 from the longitudinal inner medial side to the longitudinal outer lateral side of the sole 3. Along an inner medial side of the cross section, a longitudinal inner medial side thickness of the upper layer 4 is greater than a longitudinal inner medial side thickness of the lower layer 5 while, along an outer lateral side of the cross section, a longitudinal outer lateral side thickness of the lower layer 5 is greater than a longitudinal outer lateral side thickness of the upper layer 4.

As is obvious from FIG. 9, the actual outsole 9 may have any desired profiling 14.

In the force-displacement diagram according to FIG. 10, the sinking depth in mm is represented as a function of the loading force in N on the bearing surface. The diagram shows that, in spite of the differing layer structure, the sinking depth follows an approximately linear progression in relation to the loading up to a force of about 650 N. The different curves show different measuring cycles, with a straight line averaging the curves for comparison.

FIGS. 11 to 14 show an alternative exemplary embodiment of a sole. In FIG. 11, a lower layer 5 is shown in a perspective view. An elevation 19, with which the cutout 15 in the upper layer 4 (FIG. 12) is passed through, can be seen well. A recess 18 serves the purpose of receiving a corresponding bulge 20 in the upper layer 4.

FIG. 12 shows the sole in the bonded-together state, with its longitudinal inner side 16 and the longitudinal outer side 17.

As is obvious from FIG. 13, the vertical height a of the upper layer 4 is approximately constant everywhere on the longitudinal outer side. By contrast, according to FIG. 14, on the longitudinal inner side the upper layer 4 goes over into a convex bulge 20 and then is reduced again to the average vertical height a. The lower layer 5 widens on the longitudinal outer side 17 continuously from the toe region to the heel region, as FIG. 13 shows. On the longitudinal inner side 16, the configuration of the lower layer 5 is more complex, it being formed as somewhat thickened in the heel region and in the region of the ball of the foot.

The invention claimed is:

1. An item of footwear comprising an upper and a sole with the upper being firmly connected to the sole, and the sole comprising:

at least one upper layer facing toward the upper, at least one lower layer facing away from the upper, and the upper layer and the lower layer each comprising materials which have material properties which are different from one another, wherein the upper layer and the lower layer are one of adhesively bonded together, welded together and releasably snapped fitted together, a side of the sole, facing toward the upper, forms a bearing surface for supporting a foot of a wearer, and the upper layer comprises a ball-of-the-foot zone and a heel zone, the upper layer is a harder material than the lower layer, the upper layer has a cutout formed adjacent the ball-of-the-foot zone, the lower layer comprises an elevated region which at least partially extends into the cutout, formed in the upper layer adjacent the ball-of-the-foot zone, so that regions of both the lower layer and the upper layer together form the bearing surface and the upper layer completely surrounds the elevated region of the lower layer which at least partially extends through the cutout, the upper layer forms the heel zone while at least a portion of the lower layer forms the ball-of-the-foot zone, the sole has a longitudinal inner medial side and a longitudinal outer lateral side, and both of the longitudinal inner medial side and the longitudinal outer lateral side extend in a longitudinal direction of the item of footwear, between the ball-of-the-foot zone and the heel zone, adjacent the longitudinal inner medial side and remote from the longitudinal outer lateral side, the upper layer bulges convexly toward and into the lower layer so that a portion of the upper layer, adjacent the longitudinal inner medial side and remote from the longitudinal outer lateral side of the sole and between the ball-of-the-foot zone and the heel zone, is thicker than at least a portion of an adjacent lower layer, while the lower layer, between the ball-of-the-foot zone and the heel zone and laterally of the convex bulge adjacent the longitudinal outer lateral side of the item of footwear, is thicker than at least a portion of the upper layer, and the convex bulge extends transversally relative to the longitudinal inner medial side of the sole such that thicknesses of the upper and the lower layers of the sole vary along a cross section of the sole, the cross section extends perpendicular to both the upper and the lower layers and through the bulge from the longitudinal inner medial side to the longitudinal outer lateral side of the sole, and, along an inner medial side of the cross section, a longitudinal inner medial side thickness of the upper layer is greater than a longitudinal inner medial side thickness of the lower layer while, along an outer lateral side of the cross section, a longitudinal outer lateral side thickness of the lower layer is greater than a longitudinal outer lateral side thickness of the upper layer.

2. The item of footwear according to claim 1, wherein the upper layer and the lower layer both consist of polyethylene.

3. The item of footwear according to claim 1, wherein the upper layer has a Shore C hardness which ranges between 38 and 42 and the lower layer has a Shore C hardness which ranges between 28 and 34.

4. The item of footwear according to claim 1, wherein the upper layer has a density which ranges between 0.34 and 0.37 g/cm$^3$ and the lower layer has a density which ranges between 0.28 and 0.31 g/cm$^3$.

5. The item of footwear according to claim 1, wherein the elevated region of the lower layer forms between 25% and 45% of the bearing surface.

6. The item of footwear according to claim 1, wherein the upper layer has a constant vertical height along the longitudinal outer side, and a vertical height of the lower layer continuously increasing from the ball-of-the-foot zone to the heel zone.

7. The item of footwear according to claim 1, wherein the upper layer has a supporting border, in the form of an upward oriented flange, over a major portion of its outer periphery.

8. The item of footwear according to claim 1, wherein the sole has an outsole enveloping the upper layer and the lower layer.

9. The item of footwear according to claim 1, wherein the bearing surface of the sole is covered by a resilient textile material.

10. The item of footwear according to claim 1, wherein the materials used for manufacture of the upper layer and the lower layer have at least one of elasticities, hardnesses or densities which are different from one another.

* * * * *